US006702515B1

(12) United States Patent
Frederiksen

(10) Patent No.: US 6,702,515 B1
(45) Date of Patent: Mar. 9, 2004

(54) CORNER SUPPORT ELEMENT FOR PAVING SLABS

(75) Inventor: Ole Frederiksen, Mørke (DK)

(73) Assignee: Excellent Systems A/S, Morke (DK)

( * ) Notice: Subject to any disclaimer, the term of this patent is extended or adjusted under 35 U.S.C. 154(b) by 0 days.

(21) Appl. No.: 10/018,527

(22) PCT Filed: Jun. 23, 2000

(86) PCT No.: PCT/DK00/00335

§ 371 (c)(1),
(2), (4) Date: Feb. 20, 2002

(87) PCT Pub. No.: WO01/00947

PCT Pub. Date: Jan. 4, 2001

(30) Foreign Application Priority Data

Jun. 23, 1999 (DK) ..... 1999 00892

(51) Int. Cl.[7] ..... E04B 1/38
(52) U.S. Cl. ..... 404/41; 52/509
(58) Field of Search ..... 404/37, 40, 41, 404/43; 52/509, 263; 248/488; 403/218

(56) References Cited

U.S. PATENT DOCUMENTS

| | | | | | |
|---|---|---|---|---|---|
| 521,696 | A | * | 6/1894 | Armstrong | 52/506.08 |
| 1,006,599 | A | * | 10/1911 | Somonsen et al. | 52/463 |
| 2,201,129 | A | * | 5/1940 | Weiland | 52/509 |
| 2,382,456 | A | * | 8/1945 | Urbain | 52/506.05 |
| 2,610,856 | A | * | 9/1952 | Welty | 273/160 |
| 3,861,098 | A | * | 1/1975 | Schaub | 52/263 |
| 3,874,133 | A | * | 4/1975 | Silvius | 403/311 |
| 3,961,453 | A | | 6/1976 | Couwenbergs | |
| 4,024,683 | A | * | 5/1977 | Kilian | 52/127.3 |
| 4,074,492 | A | * | 2/1978 | Simpson et al. | 24/584.1 |
| 4,673,152 | A | * | 6/1987 | Brown | 211/40 |
| 4,749,302 | A | * | 6/1988 | DeClute | 404/37 |
| 4,803,823 | A | * | 2/1989 | Stenson | 403/218 |
| 4,835,924 | A | * | 6/1989 | Blacklin et al. | 52/263 |
| 5,013,176 | A | * | 5/1991 | Orbom | 403/171 |
| 5,671,852 | A | * | 9/1997 | Maharg | 211/182 |

FOREIGN PATENT DOCUMENTS

| | | | |
|---|---|---|---|
| AT | 235542 | 9/1964 | |
| DE | 3701679 | * 11/1987 | E04F/15/02 |
| DE | 19738477 | 3/1999 | |
| EP | 0090708 | 10/1983 | |
| JP | 5-33452 | * 2/1993 | E04F/13/08 |

* cited by examiner

*Primary Examiner*—Thomas B. Will
*Assistant Examiner*—Kristine Florio
(74) *Attorney, Agent, or Firm*—James Creighton Wray; Meera P. Narasimhan

(57) ABSTRACT

A corner support element for paving slabs has stackable plate elements to facilitate transport and for height adjustment. The guide and support elements for corner parts of paving slabs, namely plate elements, have cruciform upright support and distance providing projections. The projections are shaped as upwardly tapering elements with open cavities downwards for accommodating corresponding underlying projections. The elements are modular and can be separated along radial rows of projections to form semicircular segments for supporting two adjoining slab corners or quarter segments for supporting only a single corner. The elements are stacked in columns without turning each of the modular parts mutually between them.

7 Claims, 3 Drawing Sheets

CORNER SUPPORT ELEMENT FOR PAVING SLABS

BACKGROUND OF THE INVENTION

The present invention concerns a guide- and support-plate for corner parts of paving slabs, especially for the establishing of roof terraces, and in the form of a preferably round and dividable disk element with two rows of upright side support parts intersecting at right-angles for the slab corners. These elements, which are suitable for configuration as injection moulded items of plastic, are to a wide extent used in countries with traditions for making use of flat roof areas as terraces and walking areas, which makes it desirable to pave a roof covering or membrane with proper slabs which can be walked upon, possibly in the laying out of terraces in horizontal fields on roofs with a slight incline. It is here-with an advantage to be able to support these slabs locally at their corner areas, whereby in a simple manner, i.e. by making use of support-plate parts, a height-adjustable support for the adjoining slab corners can be achieved without having to establish any coherent, fixed support for the slabs.

SUMMARY OF THE INVENTION

It is desirable that the relevant disk elements shall be able to be stacked prior to storage and transport, but also for the equalisation of greater differences in height, and it is already known that this can be made possible by configuring each of the elements with holes in the corners, which when an element is lowered down onto an underlying element can accommodate side support parts extending upwards from the underlying element, in that this merely requires an angular turning between the two elements. Moreover, these parts can then form through-going columns in stacked elements, which can hereby stand in a stable manner.

With the present invention it has been found that for several reasons it is considerably better to configure the elements in such a way that they are directly stackable with their cruciform rows of upright side support parts lying immediately above one another, so that no thought whatsoever need be given to any mutual angular turning of the elements.

The invention is hereby characteristic in that the up-right side support parts of the element are configured in such a manner that they have decreasing breadth upwards, and are provided with an open cavity downwards which can accommodate the tapered top part of a corresponding side support part on an underlying disk element when the two elements are stacked lying closely together.

The invention will be of special significance in the cases where work is carried out in the stacking of half or quarter support elements, since these can be stacked as full columns without any mutual turning between the elements. The work will be easier to carry out, and the columns become more stable.

The invention will now be explained in more detail with reference to the drawing, in which

DETAILED DESCRIPTION OF THE PREFERRED EMBODIMENTS

The disk element shown is formed by injection moulding with a bottom plate part 2 from which a number of ring-wall parts 4 extend in an upright, concentric manner. In between these wall-parts, along two lines at right-angles to each other, there are arranged diagonal rows of upright side support parts 6, each of which is configured with a breadth which decreases upwards, but all with the same thickness seen in the circumferential direction.

Figure 1:
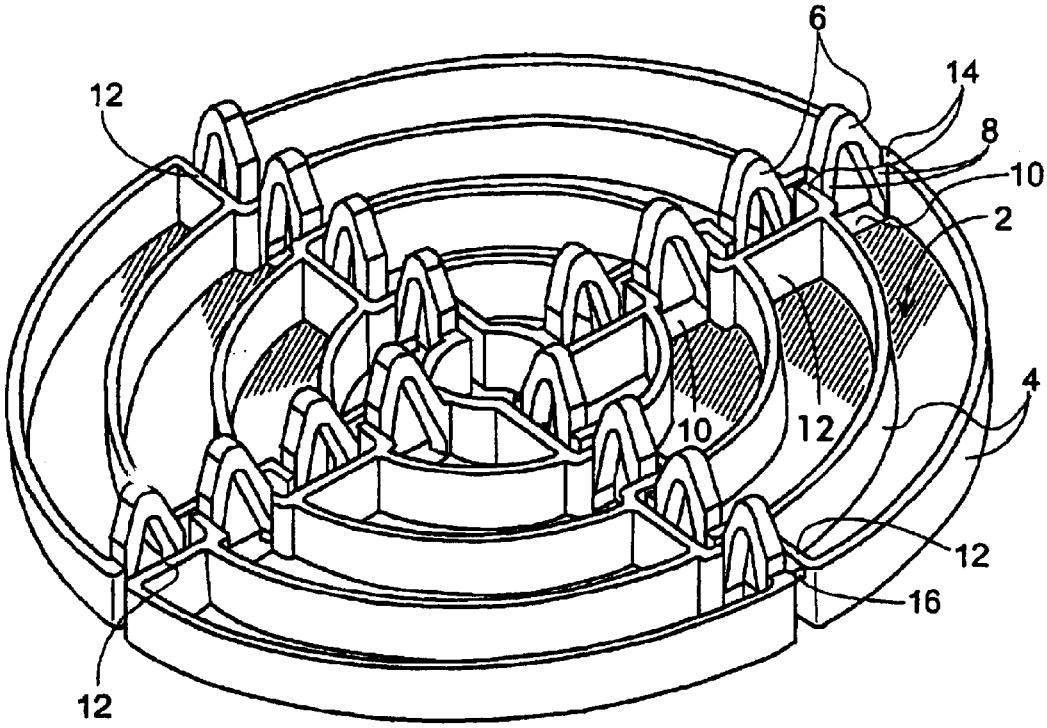
FIG. 1 is a perspective view of a disk element according to the invention.
Figure 2A:
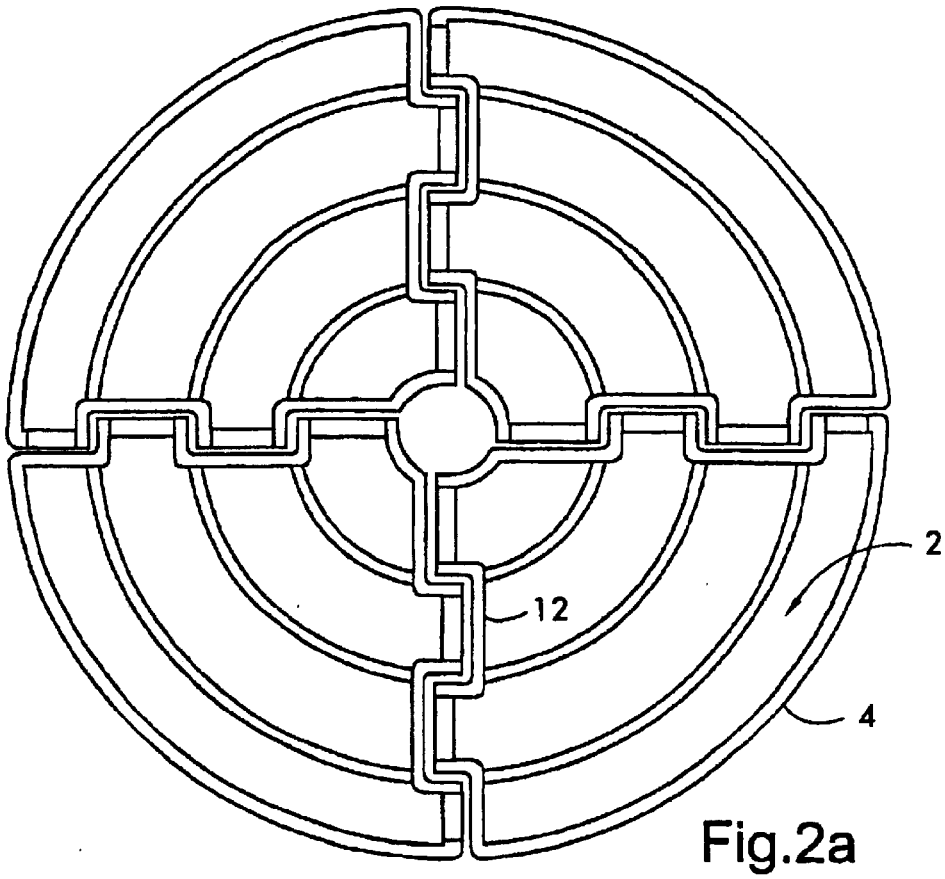
FIG. 2*a* is a bottom plan view of the elements of FIG. 1.
Figure 2B:
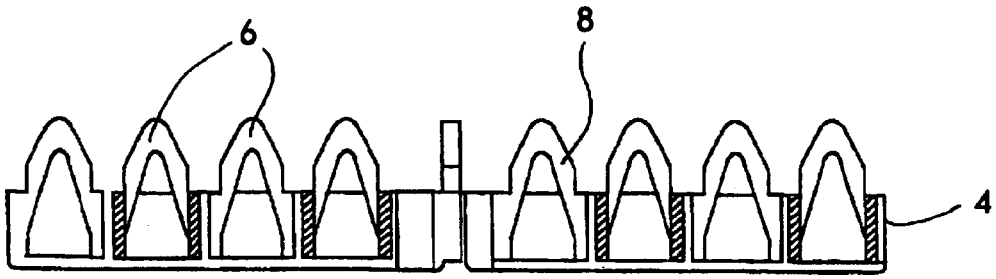
FIG. 2*b* is a side elevation of the element of FIG. 1.
Figure 3:
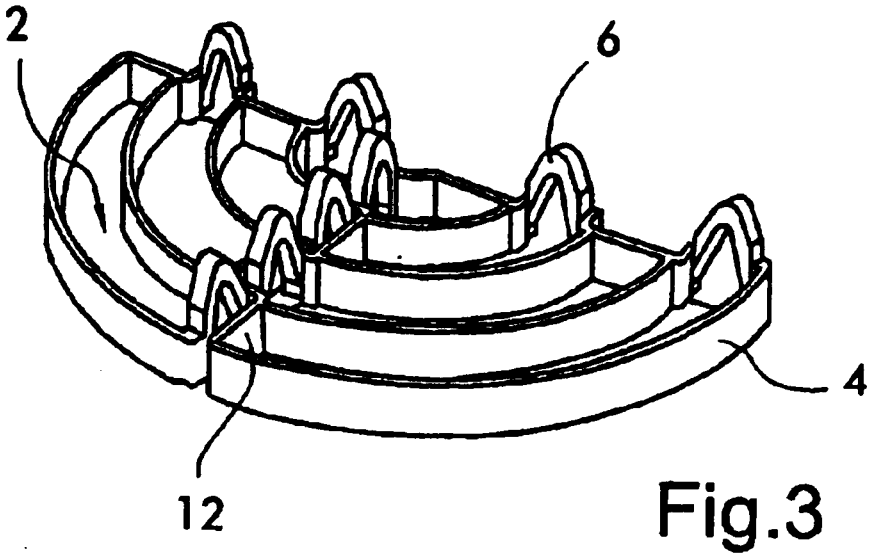
FIG. 3 is a perspective view of a half part of the divided element.
Figure 4:
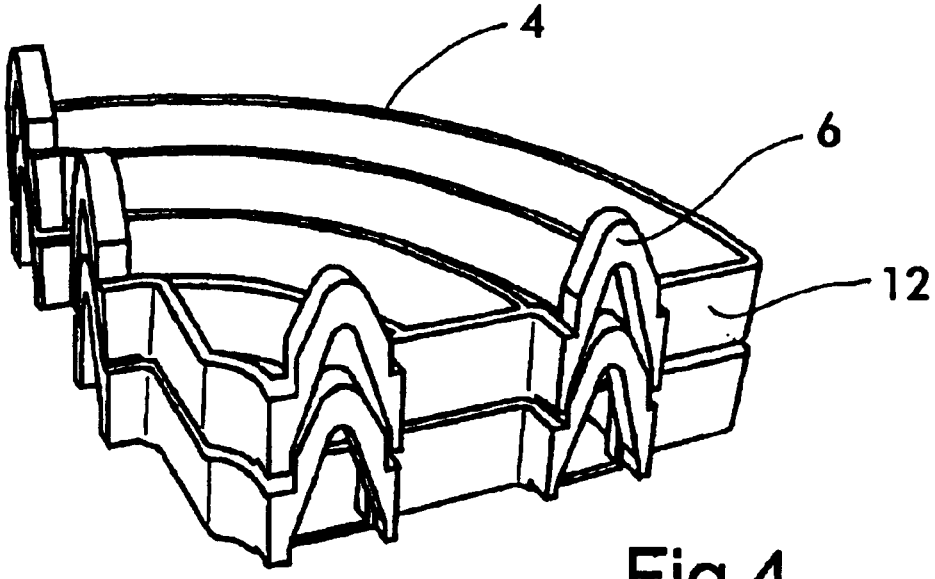
FIG. 4 is a sectional view of two stacked elements.

The support parts 6 are configured as arched elements with separate side legs 8 converging upwards and which extend upwards from an underlying break-through 10 in the bottom plate part 2. These break-through areas are sufficiently open to make it possible for the upright support parts 6 on an underlying disk element to be led up into and be accommodated in the space between the two opposing legs 8 of the upper disk element when these elements are stacked closely together, cf. FIG. 4.

Work can herewith be carried out with a possibility of bringing about a kind of snap-lock effect between the adjoining support parts 6, so that the stacked-together elements can to some degree be self-retaining in against one another, which in practice is a considerable advantage.

The upwardly-extending height of the support parts 6 can expediently be the same as or slightly less than the height of the element 2,4, so that any number of stacked-together elements can conclude in a plane manner both at the top and the bottom. The desired side guiding effect and the associated distance-providing effect between the relevant slabs will be fully sufficient with a height of e.g. 15 mm, even though the slabs are appreciably thicker.

As mentioned, it is desirable that the disk elements are easy to divide along the rows of support projections 6, namely so that these elements can be divided into half or quarter parts as desired for the supporting of a straight outer edge or respectively an outer corner of the slab paving, without it being necessary to produce special elements for these purposes. In light of this, the disk element according to the invention is built up in such a manner that each quarter segment in between the ring-walls 4 is concluded with a transverse wall part 12 at the one end, and with the upright, inverted V-shaped support part 6 at the opposite end. These support parts extend from extensions 14 of the ring-walls 4 out over the associated break-through areas 10, and they lie at a short distance from the transverse end wall 12 of the adjoining ring segment. In each radial row of support parts, every second support part will thus belong to the one quarter segment, while the remaining support parts will belong to the adjoining quarter segment.

The quarter segments thus immediately appear to be mutually completely separate, but by injection moulding of whole items the segments are formed at single places along the relevant part areas with narrow connection bridges 16 which hold the segments together in a fully stable manner, but which however allows a relatively easy breaking-over along the part areas for the formation of half and quarter disk segments.

It will be a distinctive feature of the invention that also such half and quarter disk elements allow themselves to stacked directly on top of one another in a self-retaining manner.

The upright support parts shall not necessarily be closed at the top.

What is claimed is:

1. Guide and support apparatus for corner areas of paving slabs comprising a plurality of interlocking elements forming a circular rib-plate element, a cross-formation of upstanding side support parts extending from the interlocking elements forming the rib-plate element, each support part having a tapered configuration configured in an outwardly tapering manner having an upwardly decreasing width, and each support parts comprising a downwardly open cavity complementary to the tapered configuration of each support part.

2. The apparatus of claim 1, wherein the paving slabs form roof terraces.

3. The apparatus of claim 1, wherein each interlocking element further comprises a bottom plate.

4. The apparatus of claim 3, further comprising a plurality of ring wall portions extending in an upright concentric manner from the bottom plate.

5. The apparatus of claim 4, wherein the support parts are disposed in rows along two lines arranged at right angles to each other.

6. The apparatus of claim 5, wherein each element is divided into quarter parts having segments between the ring walls, each segment in-between the ring walls comprising a transverse wall at one end and a support at an opposite end and a break-through area between each transverse wall and an adjoining support.

7. The apparatus of claim 6, wherein the supports alternate with the transverse walls in a radial direction when the interlocking elements are assembled to form the circular rib-plate element.

* * * * *

UNITED STATES PATENT AND TRADEMARK OFFICE

CERTIFICATE OF CORRECTION

PATENT NO. : 6,702,515 B1
DATED : March 9, 2004
INVENTOR(S) : Ole Frederiksen

It is certified that error appears in the above-identified patent and that said Letters Patent is hereby corrected as shown below:

Title page,
Item [75], Inventor, should read:

-- Ole Frederiksen, Hornslet, Denmark --

Signed and Sealed this

Twenty-eighth Day of September, 2004

JON W. DUDAS
*Director of the United States Patent and Trademark Office*